US008651537B2

(12) United States Patent
Imatomi et al.

(10) Patent No.: US 8,651,537 B2
(45) Date of Patent: Feb. 18, 2014

(54) DOOR LOCK APPARATUS

(75) Inventors: Yasuo Imatomi, Nishikamo-gun (JP); Kimito Shimizu, Anjo (JP); Jun Ishida, Anjo (JP)

(73) Assignee: Aisin Seiki Kabushiki Kaisha, Kariya-shi, Aichi-ken (JP)

( * ) Notice: Subject to any disclaimer, the term of this patent is extended or adjusted under 35 U.S.C. 154(b) by 1064 days.

(21) Appl. No.: 12/564,227

(22) Filed: Sep. 22, 2009

(65) Prior Publication Data

US 2010/0078945 A1 Apr. 1, 2010

(30) Foreign Application Priority Data

Sep. 29, 2008 (JP) ..... 2008-250937

(51) Int. Cl.
*E05C 3/06* (2006.01)

(52) U.S. Cl.
USPC ..... 292/216; 292/201; 292/DIG. 23

(58) Field of Classification Search
USPC ..... 292/201, 216, DIG. 23
See application file for complete search history.

(56) References Cited

U.S. PATENT DOCUMENTS

| | | | | |
|---|---|---|---|---|
| 5,155,937 | A | 10/1992 | Yamagishi et al. | |
| 5,516,167 | A | 5/1996 | Hayakawa et al. | |
| 5,618,068 | A * | 4/1997 | Mitsui et al. | 292/201 |
| 5,640,807 | A * | 6/1997 | Shigematsu et al. | 49/449 |
| 5,678,869 | A | 10/1997 | Yoshikuwa | |
| 5,944,367 | A * | 8/1999 | Imaizumi et al. | 292/201 |
| 7,210,713 | B2 | 5/2007 | Yoshida et al. | |
| 2002/0063430 | A1 * | 5/2002 | Amano | 292/201 |

FOREIGN PATENT DOCUMENTS

| | | | |
|---|---|---|---|
| CN | 1609397 | A | 4/2005 |
| CN | 101109246 | A | 1/2008 |
| CN | 201087626 | Y | 7/2008 |
| DE | 4419615 | A1 | 12/1994 |
| JP | 8-326387 | A | 12/1996 |
| JP | 9-291737 | A | 11/1997 |

OTHER PUBLICATIONS

Official Action issued by Chinese Patent Office on Mar. 8, 2013 in Chinese Application No. 200910175607.2, and English language translation of Official Action (12 pgs).

* cited by examiner

*Primary Examiner* — Kristina Fulton
(74) *Attorney, Agent, or Firm* — Buchanan Ingersoll & Rooney P.C.

(57) ABSTRACT

A door lock apparatus includes a latch mechanism having a latch being engagable with a striker and having a pawl stopping a rotation of the latch being engaged with the striker at a half latched position and a fully latched position, a half latch detection portion, a full latch detection portion, a driving portion for rotating the latch being in the half latched position toward the fully latched position, an intermediate position detection portion and a controlling portion for controlling the driving portion to start the driving portion in order to rotate the latch being in the half latched position toward the fully latched position, to stop the drive of the driving portion when the latch is in the fully latched position and to temporally stop the driving portion when the latch is in the intermediate position.

5 Claims, 7 Drawing Sheets

3 : Striker 10 : Latch mechanism 12 : Latch 14 : Pawl 31 : Latch switch (half latch detection means, full latch detection means and intermediate position detection means) 40: Actuator (driving means) 50 : Controller (controlling means)

DOOR LOCK APPARATUS

CROSS REFERENCE TO RELATED APPLICATIONS

This application is based on and claims priority under 35 U.S.C. §119 to Japanese Patent Application 2008-250937, filed on Sep. 29, 2008, the entire content of which is incorporated herein by reference.

TECHNICAL FIELD

This disclosure relates to a door lock apparatus.

BACKGROUND

According to a known door lock apparatus, for example disclosed in JPH9291737A, when a vehicle door is ajar (e.g., door is in a slightly opened state), the vehicle door is operated to be closed so as to be in a fully closed state by rotating a latch of the door lock apparatus being in a half latched position so as to be in a fully latched position.

Because the closing operation of the door lock apparatus generally continues till the vehicle door reaches its fully closed state, there is a need to consider various measures for avoiding an object insertion between the vehicle door and a vehicle body. For example, an alarm apparatus may be provided in order to make a sound of an alarm to notice the closing operation of a user. In this case, the user may avoid the object insertion on the basis of the sound of the alarm, however; the alarm may not be appropriately recognized by a user, for example a user whose audibility is relatively low.

A need thus exists to provide a door lock apparatus which is not susceptible to the drawback mentioned above.

SUMMARY

According to an aspect of the this disclosure, a door lock apparatus includes a latch mechanism having a latch adapted to be supported by a vehicle door so as to be freely rotatable and being engagable with a striker provided at a vehicle body and having a pawl adapted to be supported by the vehicle door so as to be freely rotatable and stopping a rotation of the latch being engaged with the striker, at a half latched position and a fully latched position of the latch, in order to maintain the vehicle door at a slightly opened state and a fully closed state, a half latch detection mechanism coupled to the latch for detecting a state where the latch is in the half latched position, a full latch detection mechanism coupled to the latch for detecting a state where the latch is in the fully latched position, driving means for rotating the latch being in the half latched position toward the fully latched position, a intermediate position detection mechanism coupled to the latch for detecting that the latch is in an intermediate position between the half latched position and the fully latched position and controlling means for controlling the driving means to start the drive of the driving means in order to rotate the latch toward the fully latched position on the basis of the detection that the latch is in the half latched position, to stop the drive of the driving means on the basis of the detection that the latch is in the fully latched position and to temporally stop the drive of the driving means on the basis of the detection that the latch is in the intermediate position.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
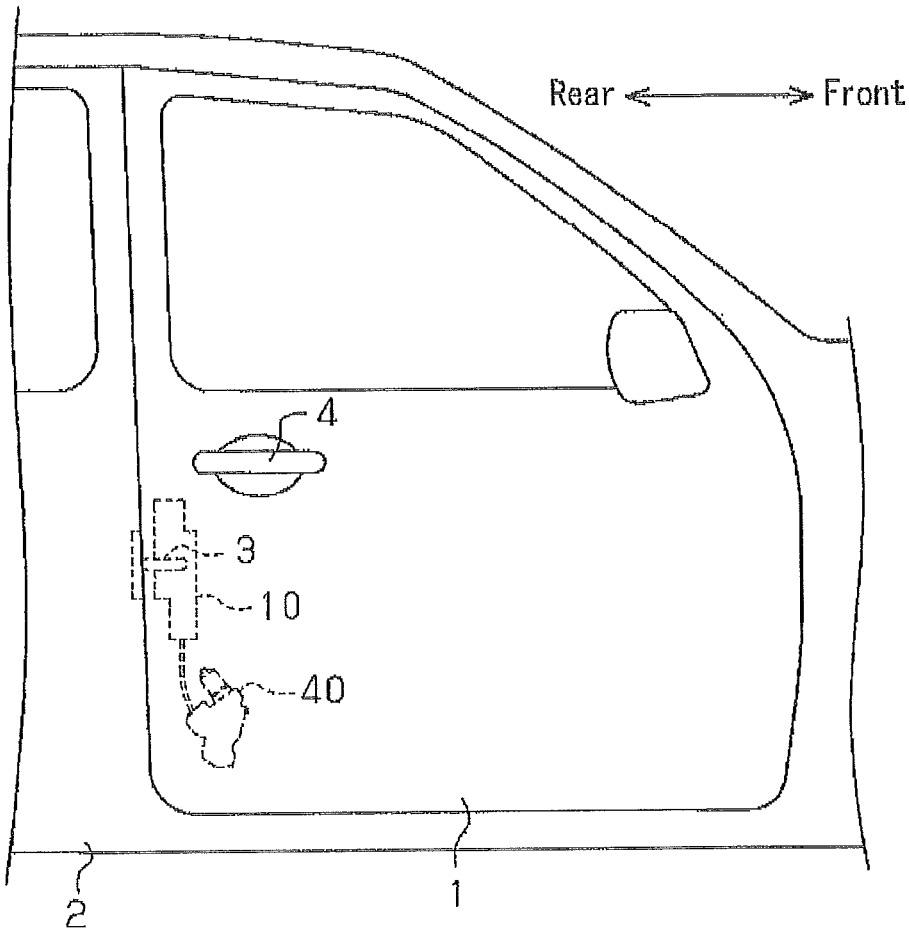
FIG. 1 illustrates a front view of a vehicle door.
Figure 2:
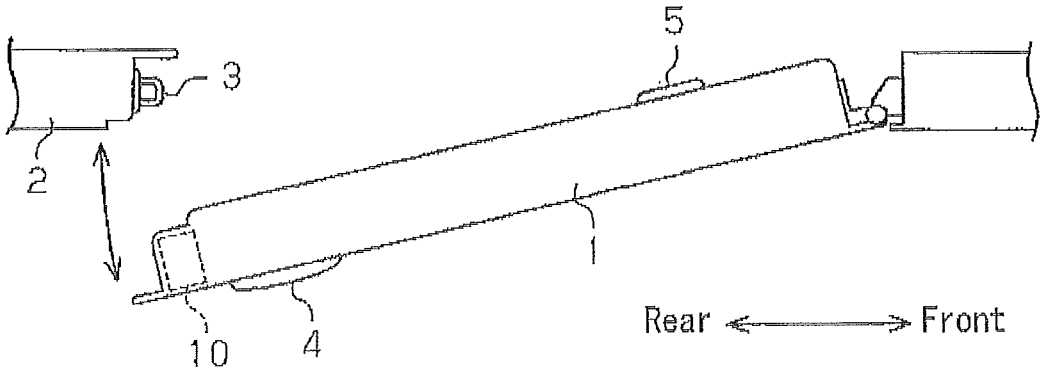
FIG. 2 illustrates a flat view of the vehicle door.

An embodiment will be explained in accordance with the attached drawings. FIG. 1 illustrates a front view indicating a vehicle door 1 to which a door lock apparatus in the embodiment is applied. FIG. 2 illustrates a plain view of the vehicle door 1 in FIG. 1. As illustrated in the plain view of FIG. 2, the vehicle door 1 is connected to a vehicle body 2 by means of a hinge allowing the vehicle door 1 to make a swing movement relative to the hinge in order to open/close a door opening of the vehicle body 2. Hereinafter, a state where the door opening is opened will be referred to as a state where the vehicle door 1 is opened, and a state where the door opening is closed will be referred to as a state where the vehicle door 1 closed. A latch mechanism 10 is mounted to the vehicle door 1 at a rear end portion thereof in a front-rear direction of the vehicle. The latch mechanism 10 is engagable with a striker 3 provided at the vehicle body 2 in order to hold the vehicle door 1 in a slightly opened state or in a fully closed state. The striker 3 is formed in a U-shape or an approximate U-shape having corners. The latch mechanism 10 is connected to each of an outside door handle 4 provided at an outer surface of the vehicle door 1 and an inside door handle 5 provided at an inner surface of the vehicle door 1, and in a case where one of the door handles 4 and 5 is operated, an operation force on the basis of the operation of the door handle 4 or 5 is transmitted to the latch mechanism 10 so that the latch mechanism 10 is operated so as to disengage the striker 3 in order to allow the vehicle door 1 to be opened.

The latch mechanism 10 is also connected to an actuator 40 serving as a driving means and is mounted within the vehicle door 1 (e.g., provided between the inner surface and the outer surface of the vehicle door 1), and when the vehicle door 1 is in the slightly opened state and the actuator 40 is driven, a driving force Of the actuator 40 is transmitted to the latch mechanism 10 so that the latch mechanism 10 is operated so as to be engaged with the striker 3 in order to move the vehicle door 1 toward the fully closed state (e.g., a closing operation of the vehicle door 1 is executed).

Figure 3:
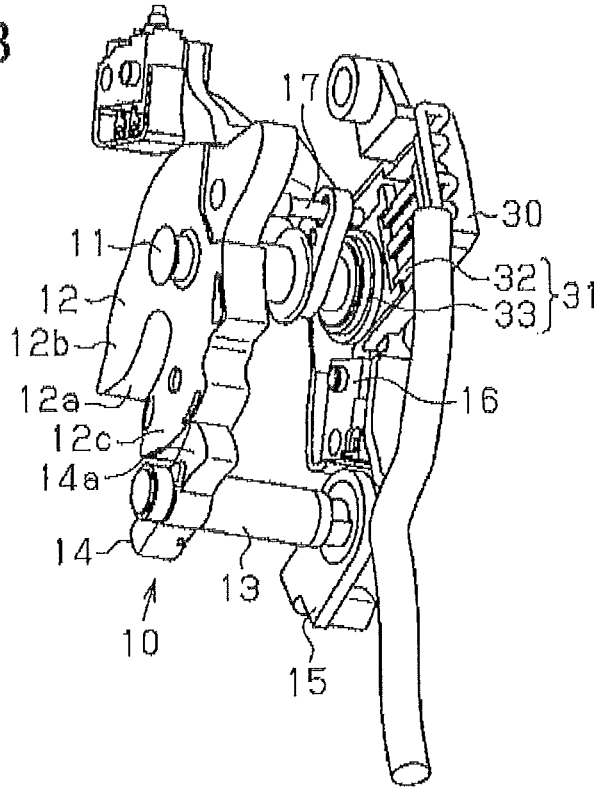
FIG. 3 illustrates an oblique perspective view of a latch mechanism.
Figure 4:
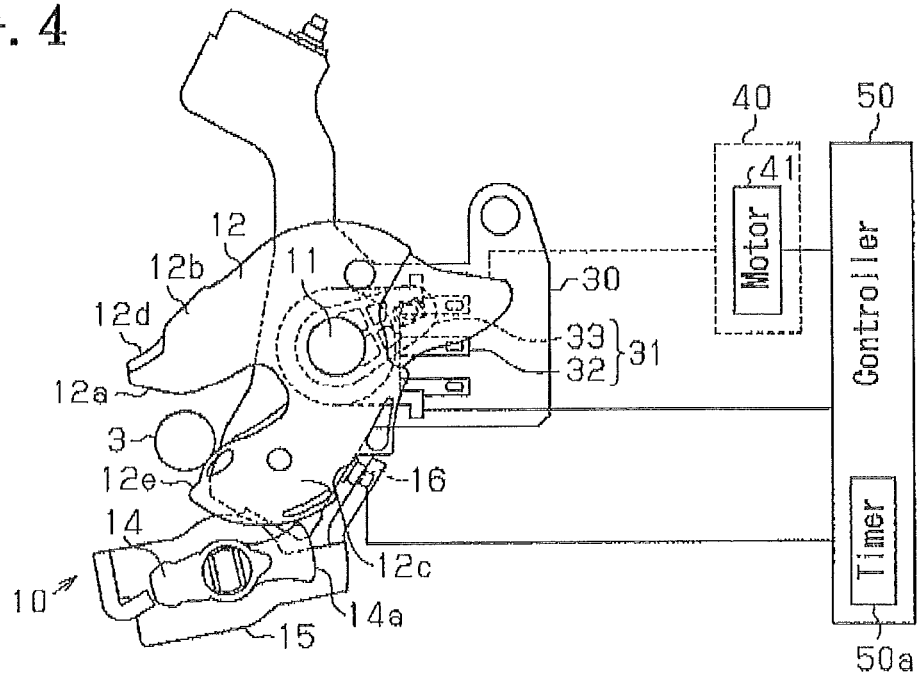
FIG. 4 illustrates a front view of the latch mechanism.

A structure of the latch mechanism 10 will be explained on the basis of FIGS. 3 and 4. FIG. 3 illustrates an oblique perspective view of the latch mechanism 10 and a structure of its surroundings. FIG. 4 illustrates a front view of the latch mechanism 10 and its surroundings. The latch mechanism 10 includes a rotational shaft 11 and a latch 12. The rotational shaft 11 is formed in a pin shape and rotatably supported by a bracket that is fixed to the vehicle door 1 of the vehicle. The latch 12 is formed in a plate shape and attached to one end portion (a left end portion in FIG. 3) of the rotational shaft 11 so as to be integrally rotatable with the rotational shaft 11. The latch 12 is formed in an approximate U-shape having two arms and a mouth portion formed between the arms. In the embodiment, the arms are referred to as first and second arm portions 12*b* and 12*c*, and the mouth portion is referred to as a striker receiving portion 12*a*. In FIG. 4, the first arm portion 12*b* is positioned at the side of the clockwise direction (e.g., at a right side), and the second arm portion 12*c* is positioned at the side of the counterclockwise direction (e.g., at a left side). A first engaging portion 12*d* is formed at an end portion of the first arm portion 12*b* at a position not facing the striker receiving portion 12*a*. A second engaging portion 12*e* is formed at an end portion of the second arm portion 12*c* at a position facing the striker receiving portion 12*a*. The latch 12 is biased by a latch biasing spring so as to rotate in a clockwise direction in FIG. 4 so as to be maintained at a predetermined position.

The latch mechanism 10 further includes a rotational shaft 13 and a pawl 14. The rotational shaft 13 is formed in a pin shape and is provided at a lower portion of the latch 12 in FIG. 3 so as to be rotatably supported by the bracket. The pawl 14 is formed in a plate shape and is attached to an end portion (a left end portion in FIG. 3) of the rotational shaft 13 so as to be integrally rotatable with the rotational shaft 13. A position of the pawl 14 in an axial direction thereof is identical to that of the latch 12. An engagable end portion 14*a* is formed so as to protrude from the rotational shaft 13 in a radial direction thereof. The pawl 14 is biased by a pawl biasing spring so as to rotate in a counterclockwise direction in FIG. 4 so as to be maintained at a predetermined initial position.

A pawl lift lever 15 is connected to the other end portion (the right end portion in FIG. 3) of the rotational shaft 13 so as to be Integrally rotatable with the rotational shaft. The pawl lift lever 15 is formed in a plate shape, and the operation force from the door handles 4 or 5 is transmittable by the pawl lift lever 15. In the vicinity of the pawl lift lever 15, a pawl switch 16 is provided in order to detect a rotation of the pawl lift lever 15, in other words a rotation of the pawl 14. When the pawl 14 is rotated, the pawl switch 16 is in a conductive state (ON state), On the other hand, when the rotation is stopped in accordance with returning to the initial position, the pawl switch 16 is in a nonconductive state (OFF state).

Further, a latch switch 31 including a rotary switch is connected to the other end portion (right end portion in FIG. 3) of the rotational shaft 11, Specifically, a holder 30 formed in a tray shape and made of resin so as to extend in a direction being orthogonal to the rotation shaft 11 is fixed to the vehicle door 1 so as to face the other end portion of the rotational shaft 11. The latch switch 31 includes a stationary member 32 and a movable member 33. The stationary member 32 is attached to the holder 30, and the movable member 33 is engaged with a connecting pin 17 so as to rotate integrally with the latch 12. The connecting pin 17 is formed so as to extend toward the holder 30 and is arranged so as to be parallel to the rotational shaft 11.

Figure 5:
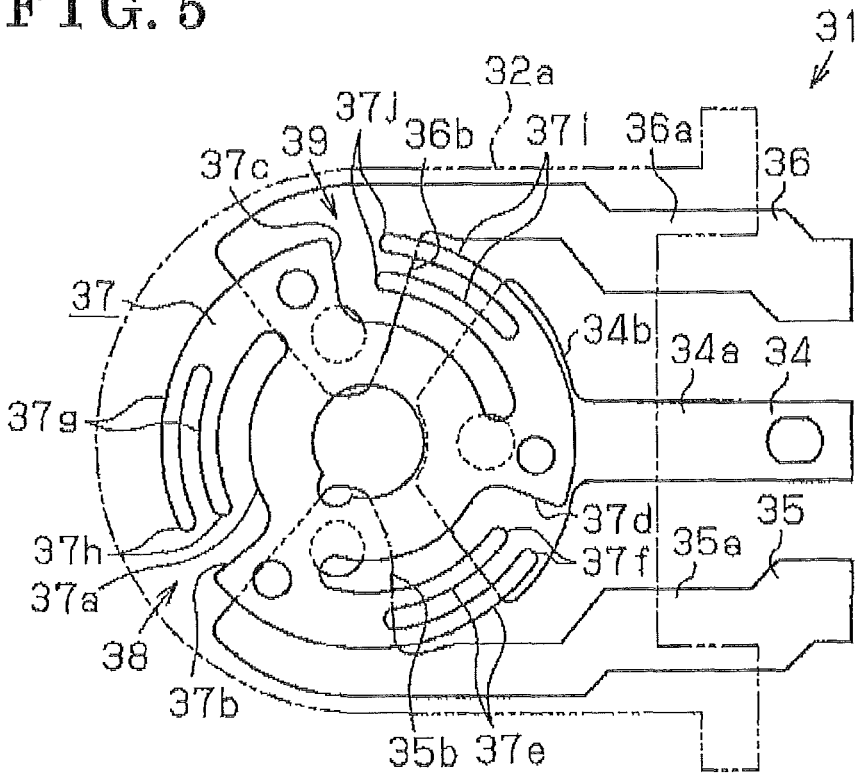
FIG. 5 illustrates a front view of a latch switch.

As illustrated in FIG. 5, the stationary member 32 includes a commonly used electrode 34, a half/full latch detection electrode 35 and an intermediate position detection electrode 36. Each of the electrodes 34, 35 and 36 is arranged in a manner where a certain portion thereof is embedded in a terminal block 32*a* having insulation properties, and an electrode plane of each of the electrodes 34, 35 and 36 is exposed to the outside (see FIG. 6).

The commonly used electrode 34 Is formed so as to include a extending piece 34*a* formed so as to extend in a radial direction of the rotational shaft 11 and a commonly used terminal 34*b* formed in a sector shape at the end portion of the commonly used electrode 34 at the side of the rotational shaft 11 so as to extend in a circumferential direction relative to the rotational shaft 11. The half/full latch detection electrode 35 is formed so as to include an extending piece 35*a* and a half/full latch detectable fixed terminal 35*b*. The extending piece 35*a* is arranged below the extending piece 34*a* and is formed so as extend approximately parallel to the extending piece 34*a*. The half/full latch detectable fixed terminal 35*b*, serving as a half latch detectable fixed terminal and a full latch detectable fixed terminal, is formed in a sector shape at an end of the extending piece 35*a* at the side of the rotational shaft 11 so as to extend upwardly toward the rotational shaft 11. The intermediate position detection electrode 36 is formed so as to include an extending piece 36*a* and an intermediate position detectable fixed terminal 36*b*. The extending piece 36*a* is arranged above the extending piece 34*a* and is formed so as to extend approximately parallel to the extending piece 34*a*. The intermediate position detectable fixed terminal 36*b* is formed in a sector shape at an end portion of the extending piece 36*a* at the side of the rotational shaft 11 so as to extend downwardly toward the rotational shaft 11. The commonly used electrode 34, the half/full latch detection electrode 35 and the intermediate position detection electrode 36 are provided in a manner where the commonly used terminal 34*b*, the half/full latch detectable fixed terminal 35*b* and the intermediate position detectable fixed terminal 36*b* are positioned on a concentric circle having a center point corresponding to an axis of the rotational shaft 11 and arranged so as to be distant from each other in a circumferential direction.

Figure 6:
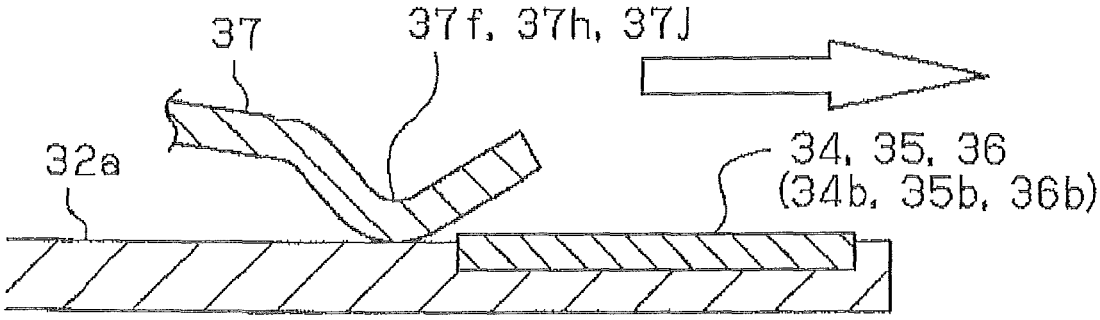
FIG. 6 illustrates a cross section of the latch switch.

On the other hand, a movable electrode 37 provided at the movable member 33 is supported by the stationary member 32 (the commonly used terminal 34*b*, the half/full latch detectable fixed terminal 35*b* and the intermediate position detectable fixed terminal 36*b*) in a manner where the movable electrode 37 contacts the stationary member 32 at points and is mainly slightly distant therefrom. The movable electrode 37 includes a ring portion 37*a* and a plurality of extending pieces, especially three radially extending pieces 37*b*, 37*c* and 37*d*. The ring portion 37*a* is formed in a ring shape, and the rotational shaft is inserted into the ring portion 37*a* so as to be rotatable. Each of the radially extending pieces 37*b*, 37*c* and 37*d* are formed so as to extend from the ring portion 37*a* outwardly in a radial direction. Each of the radially extending pieces 37*b*, 37*c* and 37*d* are arranged so as to be equally distant from each other. The movable electrode 37 further includes a pair of circumferentially extending pieces 37*e* and a pair of connecting terminals 37*f*. The circumferentially extending pieces 37*e* are formed so as to extend from the radially extending piece 37*b* toward the adjacent radially extending piece 37*d* in a circumferential direction. Each of the circumferentially extending pieces 37*e* is arranged on a concentric circle having a same central point. As illustrated in FIG. 6, an end portion of each of the circumferentially extending pieces 37*e* is bent downwardly toward the terminal block 32*a* (downwardly in FIG. 6) and further bent upwardly so as to form the V-shaped connecting terminal 37*f*. The connecting terminal 37*f* is normally slidable on the commonly used terminal 34*b* within a range of a rotation of the latch 12.

The movable electrode 37 further includes a pair of circumferentially extending pieces 37*g* and a pair of half/full latch detectable movable terminals 37*h*. The circumferentially extending pieces 37*g* are formed so as to extend from the radially extending piece 37*c* toward the adjacent radially extending piece 37*b* in a circumferential direction. Each of the circumferentially extending pieces 37*g* is arranged on a concentric circle having a same central point. An end portion of the each of the circumferentially extending pieces 37*g* is bent downwardly toward the terminal block 32*a* (downwardly in FIG. 6) and further bent upwardly so as to form the V-shaped half/full latch detectable movable terminal 37*h*. The half/full latch detectable movable terminal 37*h* is normally slidable on the half/full latch detectable fixed terminal 35*b*. The half/full latch detectable movable terminal 37*h* forms a half/full latch detection switch 38, together with half/full latch detectable fixed terminal 35*b*, serving as a half latch detection switch (e.g., half latch detection mechanism) and serving also as a full latch detection switch (e.g., full latch detection mechanism), accordingly the half/full latch detection switch 38 is also referred to as a dual function switch. The half/full latch detection switch 38 is turned to be in the ON state when the commonly used electrode 34 and the half/full latch detection electrode 35 are conducted in a case where the half/full latch detectable movable terminal 37*h* slides on the half/full latch detectable fixed terminal 35*b*. On the other hand, the half/full latch detection switch 38 is turned to be in the OFF state when the commonly used electrode 34 and the half/full latch detection electrode 35 are non-conducted in a case where the half/full latch detectable movable terminal 37*h* protrudes so as to be apart from the half/full latch detectable fixed terminal 35*b*.

The movable electrode 37 further includes a pair of circumferentially extending pieces 37*i* and a pair of intermediate position detectable movable terminals 37*j*. The circumferentially extending pieces 37*i* are formed so as to extend from the radially extending piece 37*d* toward the adjacent radially extending piece 37*c* in a circumferential direction. Each of the circumferentially extending pieces 37*i* is arranged on a concentric circle having a same central point. An end portion of the each of the circumferentially extending pieces 37*i* is bent downwardly toward the terminal block 32*a* (downwardly in FIG. 6) and further bent upwardly so as to form the V-shaped Intermediate position detectable movable terminal 37*j*. The intermediate position detectable movable terminal 37*j* is normally slidable on the intermediate position detectable fixed terminal 36*b*. The intermediate position detectable movable terminal 37*j* forms, together with the Intermediate position detectable fixed terminal 36*b*, the intermediate position detection switch 39 serving as an intermediate position detection mechanism. The intermediate position detection switch 39 is turned to be in the ON state when the commonly used electrode 34 and the intermediate position detection electrode 36 are conducted in a case where the intermediate position detectable movable terminal 37*j* slides on the intermediate position detectable fixed terminal 36*b*. On the other hand, the intermediate position detection switch 39 is turned to be in the OFF state when the commonly used electrode 34 and the intermediate position detection electrode 36 are non-conducted in a case where the intermediate position detectable movable terminal 37*j* protrudes so as to be apart from the intermediate position detectable fixed terminal 36*b*.

The latch switch 31 includes a single switch structure in which the intermediate position detection switch 39 and the half/full latch detection switch 38 (the half latch detection switch and the full latch detection switch) are integrated.

A basic actuation of the latch mechanism 10 will be explained. When the vehicle door 1 is opened, the latch 12 is biased by the latch biasing spring so as to be held at the predetermined position and postures in a manner where the striker receiving portion 12*a* thereof opens in a direction where the striker 3 enters the striker receiving portion 12*a* by the closing operation of the vehicle door 1 (see FIG. 4 and FIG. 7A). The pawl 14 is biased by the pawl biasing spring so as to be held at the initial position in a manner where the engagable end portion 14*a* of the pawl 14 contacts an outer surface of the second arm portion 12*c* of the latch 12. A state of the latch mechanism 10 at this point is referred to as an unlatched state, and a position of the latch 12 corresponding to the latch mechanism 10 being in the unlatched state is referred to as an unlatched position.

When the striker 3 enters within the striker receiving portion 12*a* in accordance with the closing operation of the vehicle door 1, the striker 3 pushes an inner surface of the striker receiving portion 12*a*, and the latch 12 is rotated in a counterclockwise direction against the biasing force of the latch biasing spring. At a position where the second engaging portion 12*e* of the latch 12 engages the engagable end portion 14*a* of the pawl 14, the rotation of the latch 12 is stopped by means of the latch 14. (see FIG. 8A). The vehicle door 1 at this point is in a slightly opened state where the striker 3 is engaged with the striker receiving portion 12*a* so as not to come out therefrom. The state of the latch mechanism 10 at this point is referred to as a half latched state, and the position of the latch 12 corresponding to the latch mechanism 10 being in the half latched state is referred to as the half latch position. When the latch 12 is rotated so as to change its posture from the unlatched position to the half latch position, the pawl 14 is rotated in accordance with the rotation of the latch 12. After the latch 12 reaches the half latched position, the pawl 14 is returned to its initial position, thereby the rotation of the latch 12 is stopped. Then the rotation of the pawl 14 is stopped.

Figure 9A:
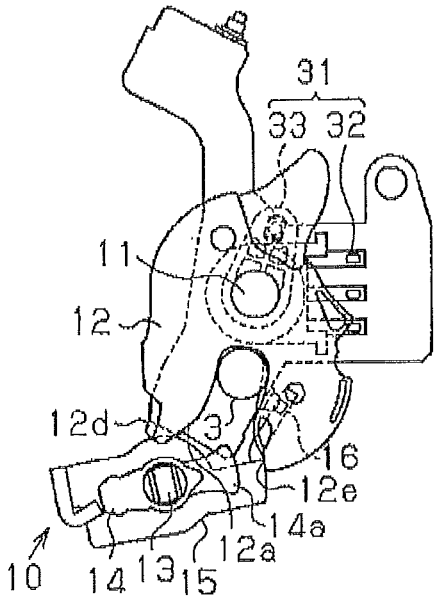
FIG. 9A illustrates a front view indicating an actuation of the latch mechanism.

Then, when the striker 3 further enters the striker receiving portion 12*a* in accordance with a further closing operation of the vehicle door 1, the striker 3 presses the inner surface of the striker receiving portion 12*a*, and the latch 12 is further rotated in an counterclockwise direction against the biasing force of the latch biasing spring, while the pawl 14 remains in an initial position (see FIG. 9A).

Figure 10A:
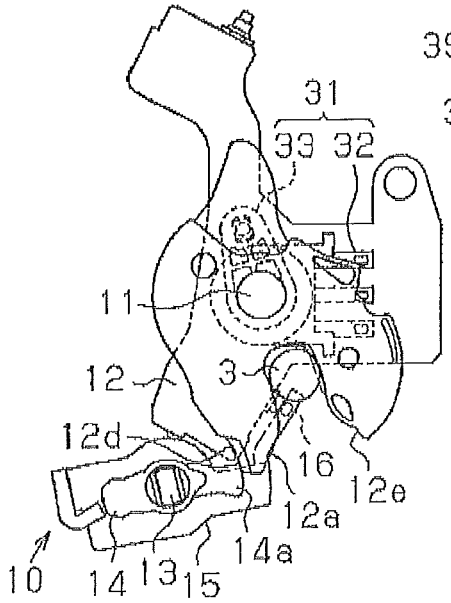
FIG. 10A illustrates a front view indicating an actuation of the latch mechanism.

Furthermore, when the striker 3 further enters the striker receiving portion 12*a* in accordance with the closing operation of the vehicle door 1, the striker 3 presses the inner surface of the striker receiving portion 12*a*, and the latch 12 is further rotated in the counterclockwise direction against the biasing force of the latch biasing spring, and then the first engaging portion 12*d* engages with the engagable end portion 14*a* so that the rotation of the latch 12 is stopped (see FIG. 10A). At this point, the vehicle door 1 is In the fully closed state where the striker 3 is engaged with the striker receiving portion 12*a* so as not to come out therefrom. A state of the latch mechanism 10 at this point is referred to as the fully latched state, and the posture of the latch 12 corresponding to the latch mechanism 10 being in the fully latched state is referred to as the fully latched position. When the latch 12 is rotated so as to change its posture from the half latch position to the fully latched position, the pawl 14 is rotated in accordance with the rotation of the latch 12. After the latch 12 is rotated so as to reach the fully latched position, the pawl 14 is returned to its initial position, at the same time the rotation of the latch 12 is stopped by means of the pawl 14, and then the rotation of the pawl 14 is stopped.

When the operation force is transmitted from one of the door handles 4 and 5 by means of the pawl lift lever 15, the pawl 14 at the half latched state or the fully latched state is rotated in the clockwise direction against the biasing force of the pawl biasing spring, and then the engagable end portion 14*a* is disengaged from the first engaging portion 12*d* or the second engaging portion 12*e*. At this point, the latch 12 is rotated in the clockwise direction in accordance with the biasing force applied by the latch biasing spring while the inner surface of the striker receiving portion 12*a* presses the striker 3. Then, the striker 3 is disengaged from the striker receiving portion 120, and the vehicle door 1 is allowed to be opened.

The latch 12 is connected to the electric motor 41 provided at the actuator 40 (see FIG. 4), and when the latch 12 is in the half latched state, the latch 12 is rotated in the counterclockwise direction by means of the electric motor 41, so that the latch mechanism 10 is turned to be in the fully latched state. In accordance with this operation, the vehicle door 1 is moved toward vehicle body 2 so as to be changed from the slightly opened state to the fully closed state.

An actuation of each of the half/full latch detection switch 38, the intermediate position detection switch 39 and the pawl switch 16, corresponding to the actuation of the latch mechanism 10 when the actuator 40 is driven in order to close the vehicle door 1, will be explained.

Figure 7A:
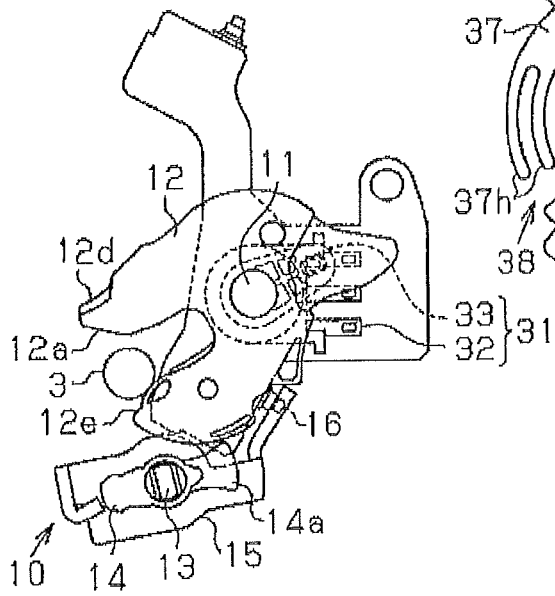
FIG. 7A illustrates a front view indicating an actuation of the latch mechanism.
Figure 7B:
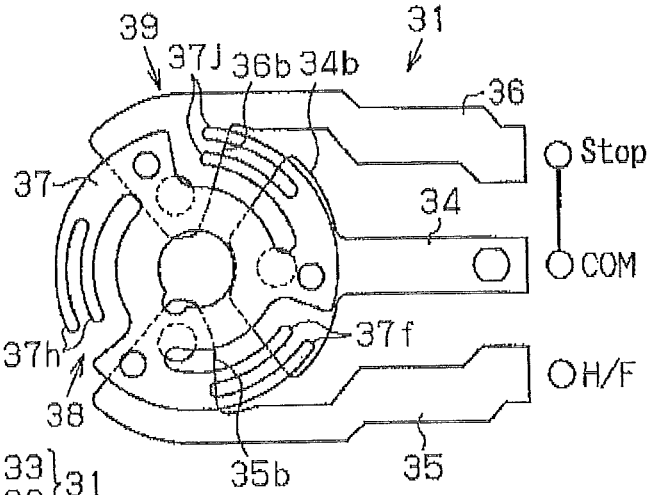
FIG. 7B illustrates a front view indicating an actuation of the latch switch.

As illustrated in the drawings of FIGS. 7A and 7B, when the latch 12 is in the unlatched position, because the half/full latch detectable movable terminal 37*h* does not contact the half/full latch detectable fixed terminal 35*b*, the state between the commonly used electrode 34 and the half/full latch detection electrode 35 is in a non-conducting state, accordingly the half/full latch detection switch 38 is turned to be in the OFF state. On the other hand, because the intermediate position detectable movable terminal 37*j* contacts the intermediate position detectable fixed terminal 36*b* so as to establish a conducting state, a state between the commonly used electrode 34 and the intermediate position detection electrode 36 is in a conducting state, accordingly the intermediate position detection switch 39 is turned to be in the ON state.

Figure 8A:
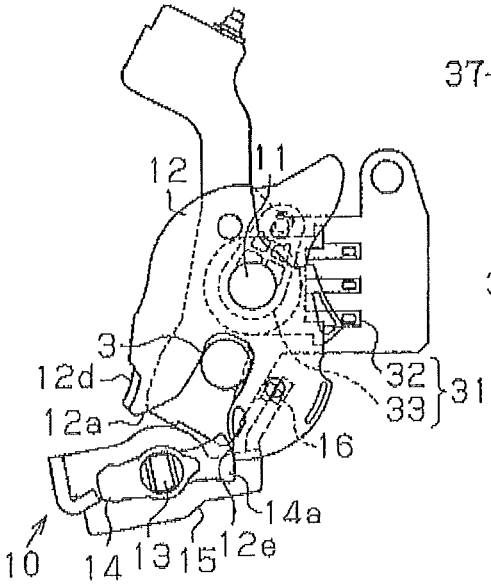
FIG. 8A illustrates a front view indicating an actuation of the latch mechanism.
Figure 8B:
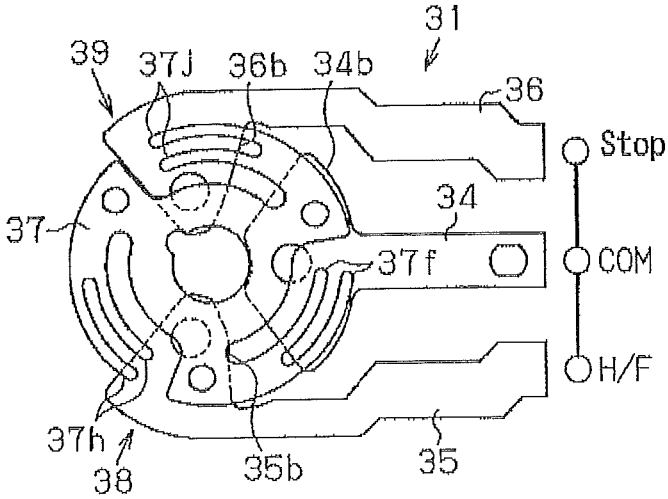
FIG. 8B illustrates a front view indicating an actuation of the latch switch.

Further, as illustrated in the drawings of FIGS. 8A and 8B, when the latch 12 is rotated to be in the half latch position, because the half/full latch detectable movable terminal 37*h* contacts the half/full latch detectable fixed terminal 35*b* so as to establish a conducting state, a state between the commonly used electrode 34 and the half/full latch detection electrode 35 is in a conducting state, accordingly the half/full latch detection switch 38 is turned to be in the ON state. According to the embodiment, the half/full latch detectable movable terminal 37*h* contacts the half/full latch detectable fixed terminal 35*b* while the pawl 14 is rotated corresponding to the rotation of the latch 12, accordingly the half/full latch detection switch 38 is turned to be In the ON state from the OFF state in a range (time period) in which the pawl switch 16 is in the ON state. On the other hand, because the intermediate position detectable movable terminal 37*j* is still contacting the intermediate position detectable fixed terminal 36*b*, the intermediate position detection switch 39 is in the ON state.

Figure 9B:
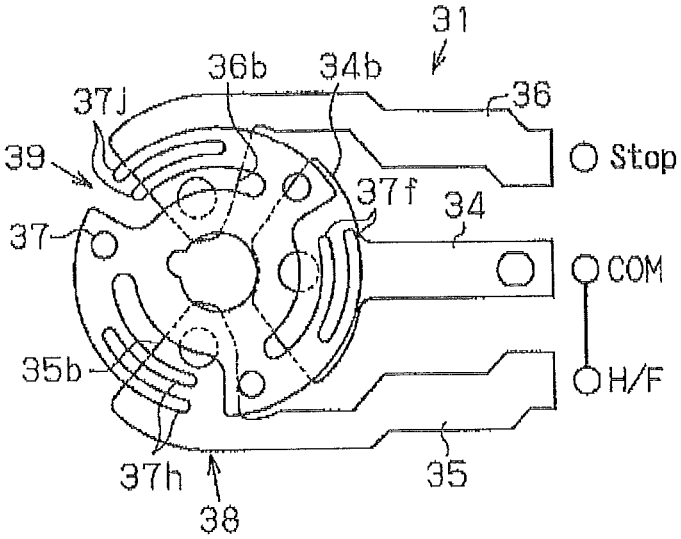
FIG. 9B illustrates a front view indicating an actuation of the latch switch.

Further, as illustrated in FIGS. 9A and 9B, when the latch 12 being in the half latch position is slightly rotated so as to be in the intermediate position, the half/full latch detectable movable terminal 37*h* is still contacting the half/full latch detectable fixed terminal 35*b*, accordingly the half/full latch detection switch 38 is still in the ON state. On the other hand, because the intermediate position detectable movable terminal 37*j* protrudes so as to be apart from the intermediate position detectable fixed terminal 36*b* at this point, a non-conducting state between the commonly used electrode 34 and the intermediate position detection electrode 36 is established, accordingly the intermediate position detection switch 39 is turned to be in the OFF state.

Figure 10B:
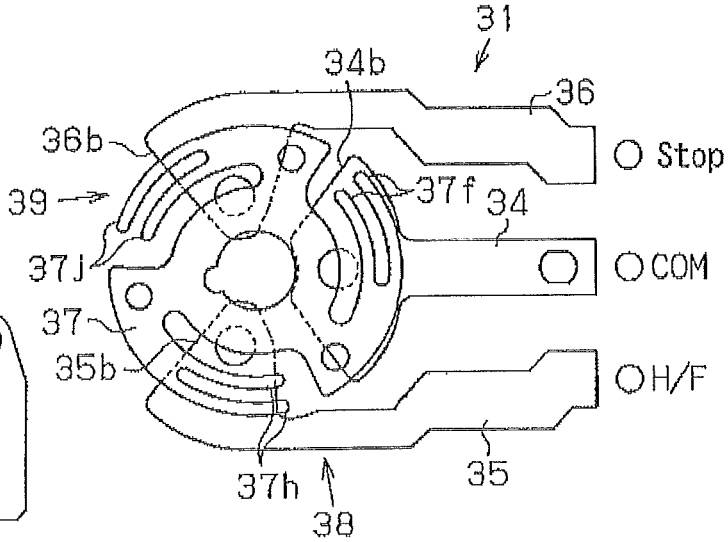
FIG. 10B illustrates a front view indicating an actuation of the latch switch.

As illustrated in the drawings of FIGS. 10A and 10B, when the latch 12 is in the fully latched position, because the half/full latch detectable movable terminal 37*h* protrudes so as to be apart from the half/full latch detectable fixed terminal 35*b*, the non-conducting state between the commonly used electrode 34 and the half/full latch detection electrode 35 is established, accordingly, the half/full latch detection switch 38 is returned to be in the OFF state (returned). Thus, the half/full latch detection switch 38 detects the half latch position or the fully latched position on the basis of the state between the half/full latch detectable fixed terminal 35*b* and the half/full latch detectable movable terminal 37*h*, and specifically, the half latch position is detected when the state between the terminals (the half/full latch detectable fixed terminal 35*b* and the half/full latch detectable movable terminal 37*h*) is in one of the conducting and non-conducting states, and the fully latched position is detected when the state between the terminals is in the other of the conducting and non-conducting states. In the embodiment, the half/full latch detection switch 38 detects the half latch position when the conducting state between the half/full latch detectable fixed terminal 35*b* and the half/full latch detectable movable terminal 37*h* Is established, and the half/full latch detection switch 38 detects the fully latched position when the non-conducting state between the half/full latch detectable fixed terminal 35*b* and the half/full latch detectable movable terminal 37*h* is established. Further, according to the embodiment, the half/full latch detectable movable terminal 37*h* does not contact the half/full latch detectable fixed terminal 35*b* while the pawl 14 is rotated corresponding to the rotation of the latch 12, accordingly the half/full latch detection switch 38 is turned to be in the OFF state from the ON state in the range (time period) in which the pawl switch 16 is in the ON state. On the other hand, because the intermediate position detectable movable terminal 37*j* does not contact the intermediate position detectable fixed terminal 36*b*, the intermediate position detection switch 39 is still in the OFF state.

Further, as illustrated in the drawing of FIG. 4, the latch switch 31 (the half/full latch detection switch 38 and the intermediate position detection switch 39) and the pawl switch 16 are electrically connected to a controller 50 serving as a controlling means, and the controller 50 controls the actuator 40 (electric motor 40), which is electrically connected thereto, so as to be driven corresponding to output signals from the latch switch 31 and the pawl switch 16.

Figure 11:
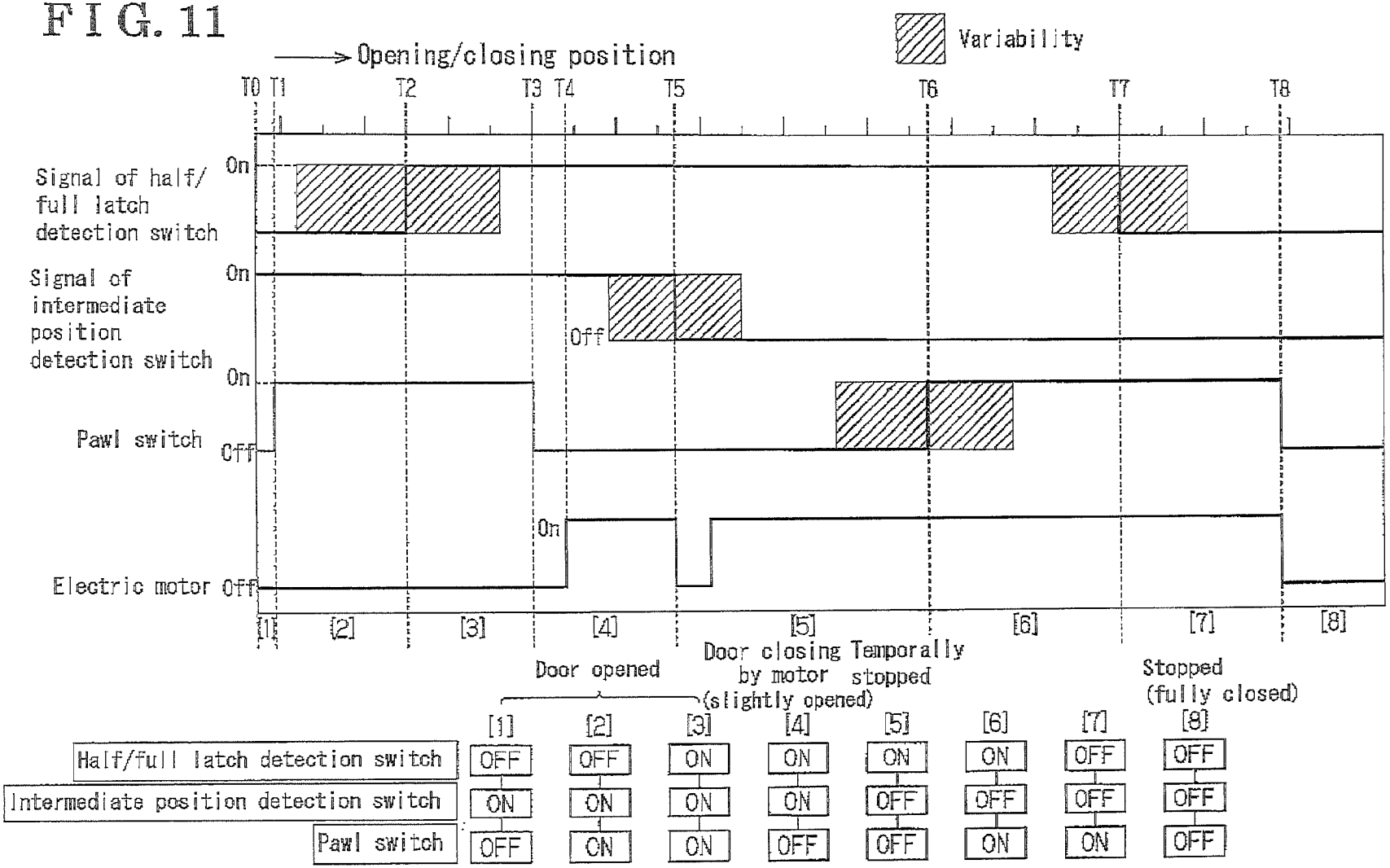
FIG. 11 illustrates a graph indicating correlations among a position of the vehicle door, output signals from the latch switch and a pawl switch and a drive signal outputted from an electric motor related to the embodiment.

FIG. 11 illustrates a graph indicating correlations among the position of the vehicle door 1 (opened/closed position) corresponding to the position of the latch 12, the output signal from the latch switch 31 (the half/full latch detection switch 38 and the intermediate position detection switch 39), the output signal from the pawl switch 16 and a drive signal outputted from the actuator 40 (electric motor 41). A range indicated by a shaded rectangle existing before and after each ON/OFF timing corresponds to a range of variability of the timing. Thus, the output signals from the latch switch 31 and the pawl switch 16 are set in a mariner where ON/OFF timings thereof including the variability are not overlapping each other.

As illustrated in the graph of FIG. 11, at the initial state (a timing T0) at which the vehicle door 1 is opened, the output signal from the half/full latch detection switch 38 is "OFF", the output signal from the intermediate position detection switch 39 is "ON", the output signal from the pawl switch 16 is "OFF", and the drive signal from the electric motor 41 is "OFF".

In this state, when the vehicle door 1 is operated to be in the slightly opened state in accordance with the closing operation of the vehicle door 1, because the pawl 14 starts to be rotated corresponding to the rotation of the latch 12, the output signal from the pawl switch 16 is turned to be in the ON state (the timing T1). Then, once the latch 12 reaches the half latch position, the output signal of the half/full latch detection switch 38 is turned to be in the ON state from the OFF state (timing T2). Further, after the latch 12 is rotated to be in the half latch position, because the rotation of the pawl 14 for stopping the rotation of the latch 12 is stopped, the output signal being in the ON state from the pawl switch 16 is turned to he In the OFF state (timing T3). In the embodiment, the controller 50 detects the slightly opened state of the vehicle door 1 on the basis of the ON state of the output signal from the half/full latch detection switch 38, the ON state of the output signal from the intermediate position detection switch 39 and OFF state of the output signal from the pawl switch 16.

The controller 50 turns on the drive signal from the electric motor 41 on the basis of the detection of the slightly opened state of the vehicle door 1 at timing T4. Then, the latch 12 is driven by the electric motor 41 and starts its rotation while the pawl 14 is in the initial position, and the closing operation of the vehicle door 1 is started. Once the latch 12 reaches the intermediate position, the output signal being in the ON state from the intermediate position detection switch 39 is turned to be in the OFF state (timing T5). On the basis of the OFF signal from the intermediate position detection switch 39, the controller 50 temporally turns off (OFF state) the drive signal of the electric motor 41, and then the controller 50 turns on (ON state) the drive signal of the electric motor 41 once again (returned). At this point, the closing operation of the vehicle door 1 is temporally stopped on the basis of the OFF state drive signal of the electric motor 41, and then the closing operation of the vehicle door 1 is started again on the basis of the ON state drive signal of the electric motor 41. A position of the vehicle door 1 (timing T5) at which the closing operation of the vehicle door 1 is temporally stopped is set to be closer to the position corresponding to the half latched state than the position corresponding to the fully latched state, so that the vehicle door 1 may be temporally stopped at a relatively early timing at which a motor output is relatively low and a door opening is relatively large. The controller 50 executes a time control for temporally turning off the drive signal of the electric motor 41 by use of an internal timer 50*a*.

While the vehicle door 1 is further rotated toward the fully closed state in accordance with the closing operation of the vehicle door 1, because the pawl 14 starts rotating corresponding to the rotation of the latch 12, the output signal from the pawl switch 16 is turned to be in the ON state again (timing T6). Then, once the latch 12 reaches the fully latched position, the output signal from the half/full latch detection switch 38 is turned to be in the OFF state from the ON state (timing T7). Then, after the rotation of the latch 12 to the fully latched position is completed, because the pawl 14 for stopping the rotation of the latch 12 stops its rotation, the output signal from the pawl switch 16 is turned to be In the OFF state from the ON state again (timing T8). In the embodiment, the controller 50 detects the fully closed state of the vehicle door 1 on the basis of OFF state of the output signal from the half/full latch detection switch 38, the OFF state of the output signal from the intermediate position detection switch 39 and the OFF state of the output signal from the pawl switch 16.

Then, the controller 50 turns off the drive signal of the electric motor 41 on the basis of the detection of the fully closed state of the vehicle door 1. Then, the drive of the electric motor 41 is stopped, and the closing operation of the vehicle door 1 is completed.

In the graph of FIG. 11, a period between the timings T0 and T1 is referred to as [1], a period between the timings T1 and T2 is referred to as [2], a period between the timings T2 and T3 is referred to as [3], a period between the timings T3 and T4 is referred to as [4], a period between the timings T4 and T5 Is referred to as [5], a period between the timings T5 and T6 is referred to as [6], a period between the timings T6 and T7 is referred to as [7], and a period between the timings T7 and T8 is referred to as [8]. Each period [1] through [8] has a unique pattern of ON/OFF states of the half/full latch detection switch 38, the intermediate position detection switch 39 and the pawl switch 16. Specifically, in the period [1], the half/full latch detection switch 38 is in the OFF state, the intermediate position detection switch 39 is in the ON state and the pawl switch 16 is in the OFF state (OFF-ON-OFF). In the period [2], the half/full latch detection switch 38 is in the OFF state, the intermediate position detection switch 39 is in the ON state and the pawl switch 16 is in the ON state (OFF-ON-ON). In the period [3], the half/full latch detection switch 38 is in the ON state, the intermediate position detection switch 39 is in the ON state and the pawl switch 16 is in the ON state (ON-ON-ON). In the period [4], the half/full latch detection switch 38 is in the ON state, the intermediate position detection switch 39 is in the ON state and the pawl switch 16 is in the OFF state (ON-ON-OFF). In the period [5], the half/full latch detection switch 38 is in the ON state, the intermediate position detection switch 39 is in the OFF state and the pawl switch 16 is in the OFF state (ON-OFF-OFF). In the period [6], the half/full latch detection switch 38 is in the ON state, the intermediate position detection switch 39 is in the OFF state and the pawl switch 16 is in the ON state (ON-OFF-ON). In the period [7], the half/full latch detection switch 38 is in the OFF state, the intermediate position detection switch 39 is in the OFF state and the pawl switch 16 is in the ON state (OFF-OFF-ON). In the period [8], the half/full latch detection switch 38 is in the OFF state, the intermediate position detection switch 39 is in the OFF state and the pawl switch 16 is in the OFF state (OFF-OFF-OFF). Accordingly, ON/OFF patterns in the periods [4] through [7], in which the electric motor 41 is driven in order to rotate the vehicle door 1 being in the slightly opened state to be in the fully closed state, may riot overlap any ON/OFF patterns in the periods [1] through [3]. Thus, even when the closing operation of the vehicle door 1 is stopped due to an increase of a reaction force of the door, it may be detectable whether or not the vehicle door 1 is in one of the periods [4] through [7] on the basis of the pattern of the signals, accordingly the vehicle door 1 may be controlled by the controller so as to start or continue the closing operation of the vehicle 1.

Figure 12:
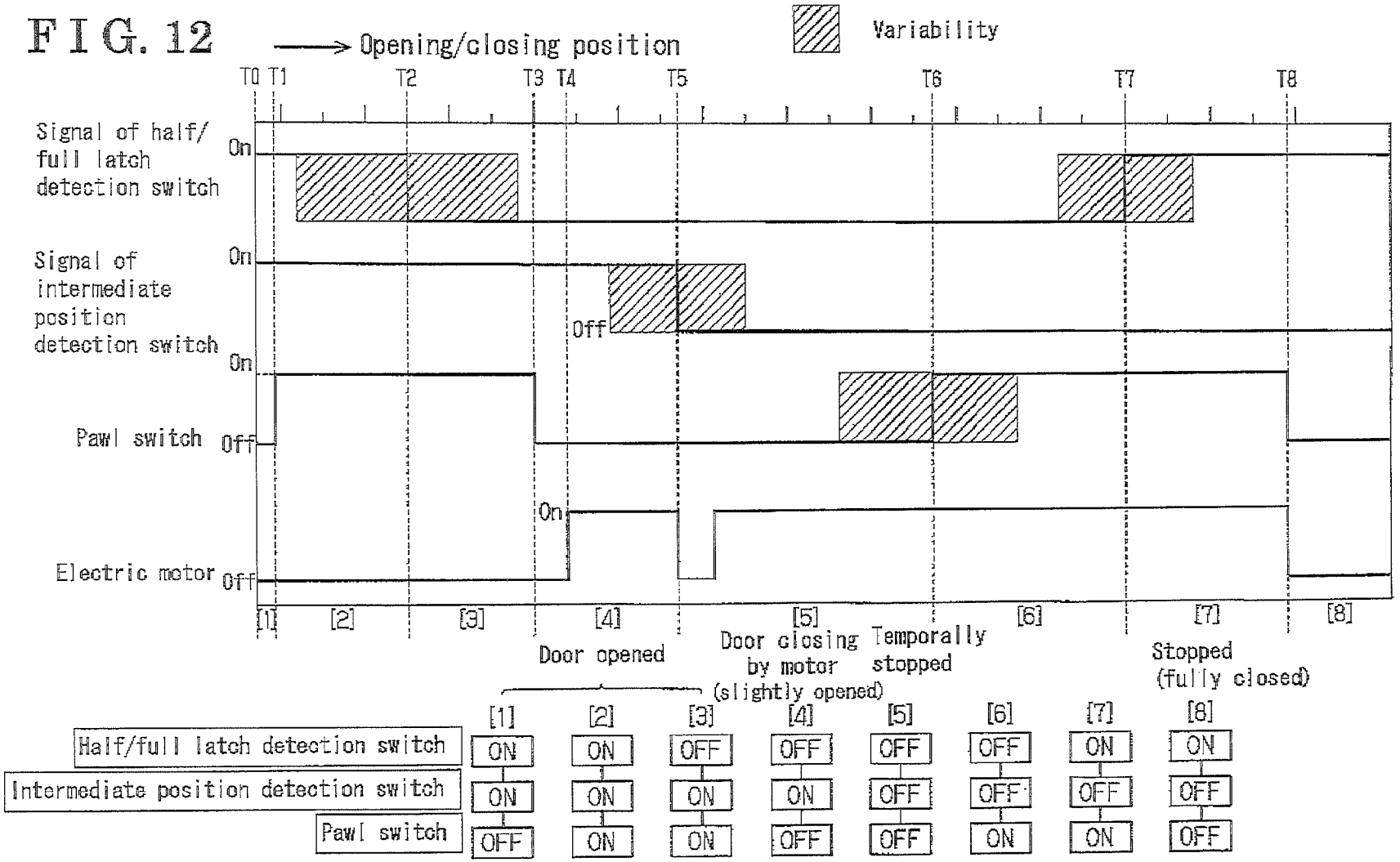
FIG. 12 illustrates a graph indicating correlations among a position of the vehicle door, output signals from the latch switch and a pawl switch and a drive signal outputted from an electric motor related to a modified embodiment.

The door lock apparatus in the embodiment may be modified as follows. As illustrated in the graph of FIG. 12, timings where the half/full latch detection switch is turned ON/OFF may be reversed from the timings indicated in the graph of FIG. 11. In other words, ON/OFF pattern of the half/full latch detection switch may be reversed. In this modified example, results similar to the embodiment may be obtained.

The rotation of the pawl 14 in the embodiment may be directly detected by the pawl switch, not using the pawl lift lever 15. Further, a half latch detection switch and a full latch detection switch may be provided separately instead of the integrated half/full latch detection switch.

The door lock apparatus in the embodiment may include the intermediate position detection switch having a switch structure in which one of the half latch detection switch and the full latch detection switch is integrated. Further, each of the half latch detection switch, the full latch detection switch and the intermediate position detection switch may include a separated switch structure.

The intermediate position at which the drive of the actuator is temporally stopped may be detected by a rotation sensor including a hall element. Alternatively, the intermediate position may be detected on the basis of the elapsed time after the vehicle door 1 is rotated so as to reach the slightly opened state.

The door lock apparatus in the embodiment may be applied to a slide type vehicle door.

A door lock apparatus includes a latch mechanism having a latch adapted to be supported by a vehicle door so as to be freely rotatable and being engagable with a striker provided at a vehicle body and having a pawl adapted to be supported by the vehicle door so as to be freely rotatable and stopping a rotation of the latch being engaged with the striker, at a half latched position and a fully latched position of the latch, in order to maintain the vehicle door at a slightly opened state and a fully closed state, half latch detection mechanism coupled to the latch for detecting a state where the latch is in the half latched position, full latch detection mechanism coupled to the latch for detecting a state where the latch is in the fully latched position, driving means for rotating the latch being in the half latched position toward the fully latched position, intermediate position detection mechanism coupled to the latch for detecting that the latch is in an intermediate position between the half latched position and the fully latched position and controlling means for controlling the driving means to start the drive of the driving means in order to rotate the latch toward the fully latched position on the basis of the detection that the latch is in the half latched position, to stop the drive of the driving means on the basis of the detection that the latch is in the fully latched position and to temporally stop the drive of the driving means on the basis of the detection that the latch is in the intermediate position.

According to the embodiment, after the actuator 40 (electric motor 41) is driven in order to rotate the latch 12 being In the half latch position so as to be in the fully latched position, the drive of the actuator 40 is temporally stopped when the latch 12 is slightly rotated from the half latch position and reaches the intermediate position. Specifically, after the vehicle door 1 being in the slightly opened state is slightly rotated toward the fully closed state (a slight actuation is executed), the closing operation of the vehicle door 1 is temporally stopped. Accordingly, even for a person whose audibility is relatively low, he/she may physically recognize the temporal closing operation of the vehicle door 1 on the basis of the temporal stop. Further, taking advantage of this temporal stop of the actuator 40 (e.g., the temporal stop of the closing operation of the vehicle door 1), an object insertion between the vehicle door 1 and the vehicle body 2 may be avoidable.

Further, the intermediate position detection mechanism is an intermediate position detection switch that is a contact type switch and includes an intermediate position detectable fixed terminal adapted to be fixed to the vehicle door and an intermediate position detectable movable terminal connected to the latch so as to be rotatable integrally therewith and turning a state between the intermediate position detectable fixed terminal and the intermediate position detectable movable terminal from one of conducting and non-conducting states to the other of the conducting and non-conducting states, when the latch is in an intermediate position.

In the embodiment, the intermediate position detection switch 39, which is a contact type switch and includes the intermediate position detectable fixed terminal **36*b* and the intermediate position detectable movable terminal 37*j*, may detect the intermediate position with high accuracy. Further, compared to another rotation sensor having a hall element and the like, the intermediate position detection switch 39** is configured with a simpler structure and its cost may be reduced.

The half latch detection mechanism is a half latch detection switch that is a contact type switch and includes a half latch detectable fixed terminal adapted to be fixed to the vehicle door and a half latch detectable movable terminal connected to the latch so as to be rotatable integrally therewith and turning a state between the half latch detectable fixed terminal and the half latch detectable movable terminal from one of conducting and non-conducting states to the other of the conducting and non-conducting states, when the latch is in a half latched position, the full latch detection mechanism is a full latch detection switch that is a contact type switch and includes a full latch detectable fixed terminal adapted to be fixed to the vehicle door and a full latch detectable movable terminal connected to the latch so as to be rotatable integrally therewith and turning a state between the full latch detectable fixed terminal and the full latch detectable movable terminal from one of conducting and non-conducting states to the other of the conducting and non-conducting states, when the latch is in a fully latched position, and the door lock apparatus has a structure where the intermediate position detection switch is integrated with at least one of the half latch detection switch and the full latch detection switch.

In the embodiment, the intermediate position detection switch 39 includes a switch structure (e.g., a rotary switch) in which the intermediate position detection switch 39 is integrated with the half/full latch detection switch 38 (the half latch detection switch and the full latch detection switch), accordingly the door lock apparatus may be downsized.

The door lock apparatus further includes the half/full latch detection switch having a dual function as the half latch detection switch and the full latch detection switch, and when the latch is in either one of the half latched position and the fully latched position, the half latched position is detected when a state between the half/full latch detectable fixed terminal, serving as a half latch detectable fixed terminal and a full latch detectable fixed terminal, and the half/full latch detectable movable terminal, serving as a half latch detectable movable terminal and a full latch detectable movable terminal, is in one of conducting and non-conducting states, and the fully latched position is detected when the state between the half/full latch detectable fixed terminal and the half/full latch detectable movable terminal is in the other of conducting and non-conducting states.

In the embodiment, because the half/full latch detection switch 38 is used for both of the half latch detection and the full latch detection, the number of the parts of the door lock apparatus may be reduced. Further, because there is no need to provide plural terminals for the half/full latch detection switches, a cost for the terminal may be reduced, and furthermore, space in which the plural terminals are supposed to be provided may be saved. Consequently, workloads and costs related to the positional change of the surrounding components related to the half/full latch detection switch may be reduced. Moreover, because the half/full latch detection switch 38 detects the half latch position when the conducting state between the half/full latch detectable fixed terminal **35*b*** and the half/full latch detectable movable terminal 37*h* is established, and the half/full latch detection switch 38 detects the fully latched position when the non-conducting state between the half/full latch detectable fixed terminal 35*b* and the half/full latch detectable movable terminal 37*h* is established, the half/full latch detection switch 38 may detect the half latch position or the fully latched position without confusion.

The door lock apparatus further includes a pawl switch changing a state thereof, when the pawl is rotated, from one of conducting and non-conducting states to the other of the conducting and non-conducting states, the half latched position and the fully latched position detected by the half/full latch detection switch are set in a range within which the pawl is rotated, the intermediate position detected by the intermediate position detection switch is set in a range within which the pawl is not rotated, the controlling means controls the driving means to start the drive of the driving means when the state of the pawl switch is changed so as to be in one of the conducting and non-conducting states after the half latched position is detected by the half/full latch detection switch, and the controlling means controls the driving means to stop the drive of the driving means when the state of the pawl switch is changed so as to be in one of the conducting and non-conducting states after the fully latched position is detected by the half/full latch detection switch.

In this configuration, when the vehicle door 1 being in the opened state is closed, because the pawl 14 is rotated in accordance with the rotation of the latch rotating so as to be in the half latched position, the pawl switch being in the non-conducting state is changed to be in the conducting states, and while the pawl switch is in the conducting state (while the pawl is rotating), the half/full latch detection switch (the half/full latch detectable fixed terminal and the half/full latch detectable movable terminal) being in the non-conducting state is changed to be in the conducting state. When the rotation of the pawl is finished, the pawl switch being in the conducting state is changed to be in the non-conducting state. At this timing, the drive of the driving means is started, and the vehicle door 1 starts or continues its closing operation.

While the pawl is not rotated, the intermediate position detection switch (the intermediate position detectable fixed terminal and the intermediate position detectable movable terminal) being in the conducting state is changed to be in the non-conducting state. Then the pawl is rotated in accordance with the rotation of the latch toward its fully latched position, accordingly, the pawl switch being in the non-conducting state is changed to be in the conducting state. While the pawl is rotated, the half/full latch detection switch (the half/full latch detectable fixed terminal and the half/full latch detectable movable terminal) being in the conducting state is changed to be in the non-conducting state. Then, the rotation of the pawl is finished, and the pawl switch being in the conducting state is changed to be in the non-conducting state. At this point, the drive of the driving means is stopped, as a result, the closing operation of the vehicle door is finished.

In the embodiment, even though the half/full latch detection switch has a dual function as the half latch detection and the full latch detection, each period has a unique pattern of ON/OFF states of the half/full latch detection switch 38, the intermediate position detection switch 39 and the pawl switch 16 in a period between when the vehicle door 1 is opened and when the closing operation of the vehicle door is completed. Accordingly, when the actuator 40 needs to be driven in order to execute the closing operation of the vehicle door 1, an operational error on the actuator 40 on the basis of a misdetection of the opened state of the vehicle door 1 may be avoidable. For example, even when the closing operation of the vehicle door 1 is stopped due to an increase of a reaction force of the door, it may be detectable where of not the vehicle door 1 is in one of the periods [4] through [7] on the basis of the pattern of the signals, accordingly vehicle door 1 may be controlled by the controller so as to start or continue the closing operation of the vehicle 1.

According to the embodiment, a position of the vehicle door 1 (timing T5) at which the closing operation of the vehicle door 1 is temporally stopped is set to be closer to the position corresponding to the half latched state (timing T3) than the position corresponding to the fully latched state (timing T8), so that the vehicle door 1 may be temporally stopped at a relatively early timing at which a motor output is relatively low and a door opening is relatively large.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A door lock apparatus comprising:

a latch mechanism having a latch adapted to be supported by a vehicle door so as to be freely rotatable and being engagable with a striker provided at a vehicle body and having a pawl adapted to be supported by the vehicle door so as to be freely rotatable and stopping a rotation of the latch being engaged with the striker, at a half latched position and a fully latched position of the latch, in order to maintain the vehicle door at a slightly opened state and a fully closed state;

a half latch detection mechanism coupled to the latch which detects a state where the latch is in the half latched position;

a full latch detection mechanism coupled to the latch which detects a state where the latch is in the fully latched position;

driving means which rotates the latch being in the half latched position toward the fully latched position;

an intermediate position detection mechanism coupled to the latch which detects that the latch is in an intermediate position between the half latched position and the fully latched position; and controlling means which controls the driving means to start the drive of the driving means in order to rotate the latch toward the fully latched position on the basis of the detection that the latch is in the half latched position, to stop the drive of the driving means on the basis of the detection that the latch is in the fully latched position and to temporally stop the drive of the driving means on the basis of the detection that the latch is in the intermediate position.

2. The door lock apparatus according to Claim 1, wherein the intermediate position detection mechanism is an intermediate position detection switch that is a contact switch and includes an intermediate position detectable fixed terminal adapted to be fixed to the vehicle door and an intermediate position detectable movable terminal connected to the latch so as to be rotatable integrally therewith and turning a state between the intermediate position detectable fixed terminal and the intermediate position detectable movable terminal from one of conducting and non-conducting states to the other of the conducting and non-conducting states, when the latch is in an intermediate position.

3. The door lock apparatus according to Claim 2, wherein the half latch detection mechanism is a half latch detection switch that is a contact switch and includes a half latch detectable fixed terminal adapted to be fixed to the vehicle door and a half latch detectable movable terminal connected to the latch so as to be rotatable integrally therewith and turning a state between the half latch detectable fixed terminal and the half latch detectable movable terminal from one of conducting and non-conducting states to the other of the conducting and non-conducting states, when the latch is in a half latched position, the full latch detection mechanism is a full latch detection switch that is a contact switch and includes a full latch detectable fixed terminal adapted to be fixed to the vehicle door and a full latch detectable movable terminal connected to the latch so as to be rotatable integrally therewith and turning a state between the full latch detectable fixed terminal and the full latch detectable movable terminal from one of conducting and non-conducting states to the other of the conducting and non-conducting states, when the latch is in a fully latched position, and the door lock apparatus has a structure where the intermediate position detection switch is integrated with at least one of the half latch detection switch and the full latch detection switch.

4. The door lock apparatus according to Claim 3 further includes a the half/full latch detection switch having a dual function as the half latch detection switch and the full latch detection switch, and when the latch is in either one of the half latched position and the fully latched position, the half latched position is detected when a state between the half/full latch detectable fixed terminal, serving as a half latch detectable fixed terminal and a full latch detectable fixed terminal, and the half/full latch detectable movable terminal, serving as a half latch detectable movable terminal and a full latch detectable movable terminal, is in one of conducting and non-conducting states, and the fully latched position is detected when the state between the half/full latch detectable fixed terminal and the half/full latch detectable movable terminal is in the other of conducting and non-conducting states.

5. The door lock apparatus according to Claim 4, wherein the door lock apparatus further includes a pawl switch changing a state thereof, when the pawl is rotated, from one of conducting and non-conducting states to the other of the conducting and non-conducting states, the half latched position and the fully latched position detected by the half/full latch detection switch are set in a range within which the pawl is rotated, the intermediate position detected by the intermediate position detection switch is set in a range within which the pawl is not rotated, the controlling means controls the driving means to start the drive of the driving means when the pawl switch being in the other of the conducting and non-conducting states is changed so as to be in the one of the conducting and non-conducting states after the half latched position is detected by the half/full latch detection switch, and the controlling means controls the driving means to stop the drive of the driving means when the pawl switch being in the other of the conducting and non-conducting states is changed so as to be in the one of the conducting and non-conducting states after the fully latched position is detected by the half/full latch detection switch.

* * * * *